US007353686B2

(12) United States Patent
Kanemitsu et al.

(10) Patent No.: US 7,353,686 B2
(45) Date of Patent: Apr. 8, 2008

(54) PRESS

(75) Inventors: Toshiaki Kanemitsu, Hyogo (JP); Kazuyuki Oda, Hyogo (JP); Keiichiro Yamamura, Shizuoka (JP)

(73) Assignee: Kanemitsu Corporation, Ookurahonmachi, A Kashi-shi, Hyogo (JP)

( * ) Notice: Subject to any disclaimer, the term of this patent is extended or adjusted under 35 U.S.C. 154(b) by 347 days.

(21) Appl. No.: 10/531,269

(22) PCT Filed: Oct. 24, 2002

(86) PCT No.: PCT/JP02/11041

§ 371 (c)(1),
(2), (4) Date: Apr. 13, 2005

(87) PCT Pub. No.: WO2004/037528

PCT Pub. Date: May 6, 2004

(65) Prior Publication Data

US 2006/0011039 A1 Jan. 19, 2006

(51) Int. Cl.
*B30B 15/26* (2006.01)
*B30B 15/14* (2006.01)

(52) U.S. Cl. ..... 72/454; 72/17.2; 100/43; 100/46

(58) Field of Classification Search ..... 72/17.2, 72/390.06, 453.08, 453.02, 454, 455; 100/43, 100/46, 99, 258 A, 258 R, 342, 343
See application file for complete search history.

(56) References Cited

U.S. PATENT DOCUMENTS

| | | | | |
|---|---|---|---|---|
| 6,237,479 | B1 * | 5/2001 | Douba | 100/48 |
| 6,520,077 | B1 * | 2/2003 | Minagawa et al. | 72/454 |
| 6,543,121 | B2 * | 4/2003 | Speller et al. | 29/525.06 |
| 6,679,164 | B2 * | 1/2004 | Futamura et al. | 100/291 |
| 6,810,704 | B2 * | 11/2004 | Futamura et al. | 72/17.2 |
| 7,007,529 | B2 * | 3/2006 | Futamura et al. | 72/20.1 |
| 7,082,809 | B2 * | 8/2006 | Balasu | 72/454 |
| 7,143,617 | B2 * | 12/2006 | Futamura et al. | 72/20.1 |

FOREIGN PATENT DOCUMENTS

| | | |
|---|---|---|
| JP | 2-207999 | 8/1990 |
| JP | 6-23700 | 3/1994 |
| JP | 8-174097 | 7/1996 |
| JP | 10-277791 | 10/1998 |
| JP | 2002-46000 | 2/2002 |
| JP | 2002-160243 | 6/2002 |
| JP | 2002-224889 | 8/2002 |

* cited by examiner

*Primary Examiner*—David B Jones
(74) *Attorney, Agent, or Firm*—Bacon & Thomas, PLLC

(57) ABSTRACT

A press comprises a servo motor (6), a ball screw (9), and a roller guide (11) in which machining accuracy is enhanced while reducing the overall size and weight, noise and vibration, and power consumption of the press.

5 Claims, 11 Drawing Sheets

PRESS

FIELD OF THE INVENTION

The present invention relates to a press used for plastically forming machine parts into a predetermined form by extrusion, punching, deep drawing, or the like, or for cutting sheet metals.

BACKGROUND OF THE INVENTION

Previously known presses of the above-mentioned type include a press that is constituted in a manner disclosed in Japanese Patent Application Laying-Open No. 2002-224889, for example. That is, a pressing member is slidably supported by a support to move up and down in order to press a workpiece, the pressing member being coupled through a crankshaft to a flywheel rotatably coupled to a motor, so that the pressing member is driven up and down by the rotational driving force of the motor through the flywheel and the crankshaft.

There is also another press that is constituted in a manner disclosed in Japanese Patent Application Laying-Open No. 8-174097. That is, an upper turret (which corresponds to a pressing member) slidably supported by a support to move up and down and including a punch for punching out a workpiece is driven up and down by a hydraulic cylinder, and a flywheel is attached to the driving shaft of an inclined plane variable capacity hydraulic pump that applies pressure to the hydraulic cylinder, which flywheel is driven by a motor via a belt.

Further, a press has been also known heretofore that utilizes a pneumatic cylinder as an alternative to the hydraulic cylinder.

In these known presses, the inertia of the flywheel is utilized to level out the fluctuations in the rotational speed of the motor, as well as to accumulate the rotational energy to carry out predetermined press works reliably. The motor for rotationally driving the heavy flywheel, however, generates very large noise and vibration, and thus being one of the causes of working environment deterioration.

Further, for the conventional press with a flywheel, the presence of the flywheel is a limiting factor for the reduction in size and weight of the press, and also causes a large loss of power since the flywheel is maintained to continuously rotate even when a press work is not performed. These problems become more serious in a large press that provides a large maximum pressing force.

In addition, in order to improve machining accuracy, it is desirable that the operation of a press, such as the operation speed thereof and the position and lifting stroke of a pressing member, being flexibly controlled in accordance with the goods to be manufactured, and that the machining condition of the press being always programmed optimally. The above mentioned conventional presses with flywheel, however, are difficult to operate so as to achieve high machining accuracy.

SUMMARY OF THE INVENTION

Taking into account the above, the object of the present invention is to provide a press of low noise and vibration, small size and light weight, and low running cost due to low power consumption, and also being programmable for data on operation control and machining conditions to achieve a remarkable improvement in press work accuracy.

In order to achieve the object mentioned above, the press according to the present invention as described in claim 1 comprises a motor supported by a support, a lifting mechanism driven up and down by the rotation of said motor, and a pressing member fixedly coupled to a lower end of said lifting mechanism to press a workpiece, wherein said motor is constituted by a servo motor of which rotation is controlled by a control mechanism, said lifting mechanism being constituted by a ball screw comprising a ball screw shaft, a ball screw nut screw threaded with said ball screw shaft, and balls introduced into transferring grooves so as to be able to roll therein, said transferring grooves formed on said ball screw shaft and said ball screw nut, one of said ball screw shaft and said ball screw nut of said lifting mechanism being coupled to a driving shaft rotatably interlocked with the servo motor, while the other being fixedly coupled to said pressing member.

According to the invention described in claim 1, which has the above mentioned constituent features, the driving mechanism of the pressing member is constituted by a combination of the servo motor, of which rotation is controllable, and the ball screw, and no flywheel is used. Thus, the overall size and weight of the press is reduced, and noise and vibration of the motor due to rotationally driving the flywheel do not occur, achieving a significant improvement of working environment. Further, waste power consumption during the standby or suspension of the press is eliminated, thereby allowing reduction in the power consumption of the press and hence substantial savings in the running cost.

Further, the combination of the ball screws having low friction and excellent mechanical efficiency and the servo motors having automatic tracking ability permits full power output over the entire lifting stroke. Thus, the press is applicable to a wide range of press works in which both large and small pressing forces are required. In addition, the operating speed and position, the lifting stroke, or the like, of the pressing member is controllable flexibly and with high accuracy in accordance with the products to be manufactured, which allows a significant improvement of press work accuracy.

In particular, since the control mechanism associated with the servo motor is constituted by a numerically controlled apparatus programmable for numerical data on press work conditions, as described in claim 2, die replacement allows to be carried out with ease and high accuracy, achieving an remarkable improvement in press work accuracy and also in productivity.

Preferably, as the embodiment described in claim 3, a plurality of roller guides are employed as lift guiding means of the pressing member in the press according to the present invention having the above structure, the roller guide comprising a rail fixed to the support, a lift block fixed to the pressing member, and a roller making rolling contact at an outer peripheral surface thereof with said rail and said lift block.

The embodiment of the invention described in claim 3 allows the overall size of the press to be less than in the case where a supporting guide of a large wall structure extending around the periphery of the pressing member is provided to the support, while preventing skew of the pressing member at the time of applying press load. In addition, the press ensures stable and smooth up and down movement due to small rolling resistance. Thus, the press allows a further improvement in press work accuracy.

Further, in the press according to the present invention, although one pressing member may be provided with one servo motor and one ball screw, one pressing member may be also provided with a plurality of servo motors and ball screws as describe in claim 4.

According to the embodiment of the invention described in claim 4, a large press for generating a pressing force of more than 100 tons becomes feasible by concentrating the rotational driving forces from the plurality of servo motors on one pressing member, and the combination of the servo motors and the ball screws allows low noise, low vibration, and low power consumption as well as high press work accuracy even for such a large press.

In particular, the large press that employs a plurality of servo motors and ball screws for one pressing member is preferably provided with a plurality of roller guides arranged around the one pressing member, as described in claim 5.

According to the embodiment of the present invention described in claim 5, the plurality of ball screws prevent, like in the embodiment of the present invention described in claim 2, skew of the pressing member even when a large pressing load is applied to the one pressing member, and ensure a stable and smooth up and down movement of the pressing member due to their small rolling resistance. Thus, high press work accuracy is maintained although the output pressing-force is large.

Further, a slidably guiding mechanism may be used as the lift guiding means of the pressing member of the press according to the present invention, which slidably guiding means comprises a columnar member provided vertically to the support, and a slider fixed to the pressing member and fitted onto the columnar member to be supported thereby. In this case, more than one slidably guiding mechanism is preferably provided around one pressing member.

Also the embodiments of the present invention allow the overall size and weight of the press to be less than in the case where a supporting guide of a large wall structure extending around the periphery of the pressing member is provided to the support, while keeping the press work accuracy sufficiently high.

Further, in the press of the present invention, means for rotatably coupling the servo motor and the driving shaft may be either of the timing belt and pulley or the gear trains. The rotatably coupling means utilizing the gear trains is preferable for a large press. For small or medium presses, the use of the timing belt and timing pulley significantly reduces the noise, resulting in a further improvement in working environment.

DETAILED DESCRIPTION OF THE PREFERRED EMBODIMENTS

Hereinafter, an embodiment of a press according to the present invention described in claims 1 through 5 and 9 will be illustrated with reference to the drawings.

Figure 1:
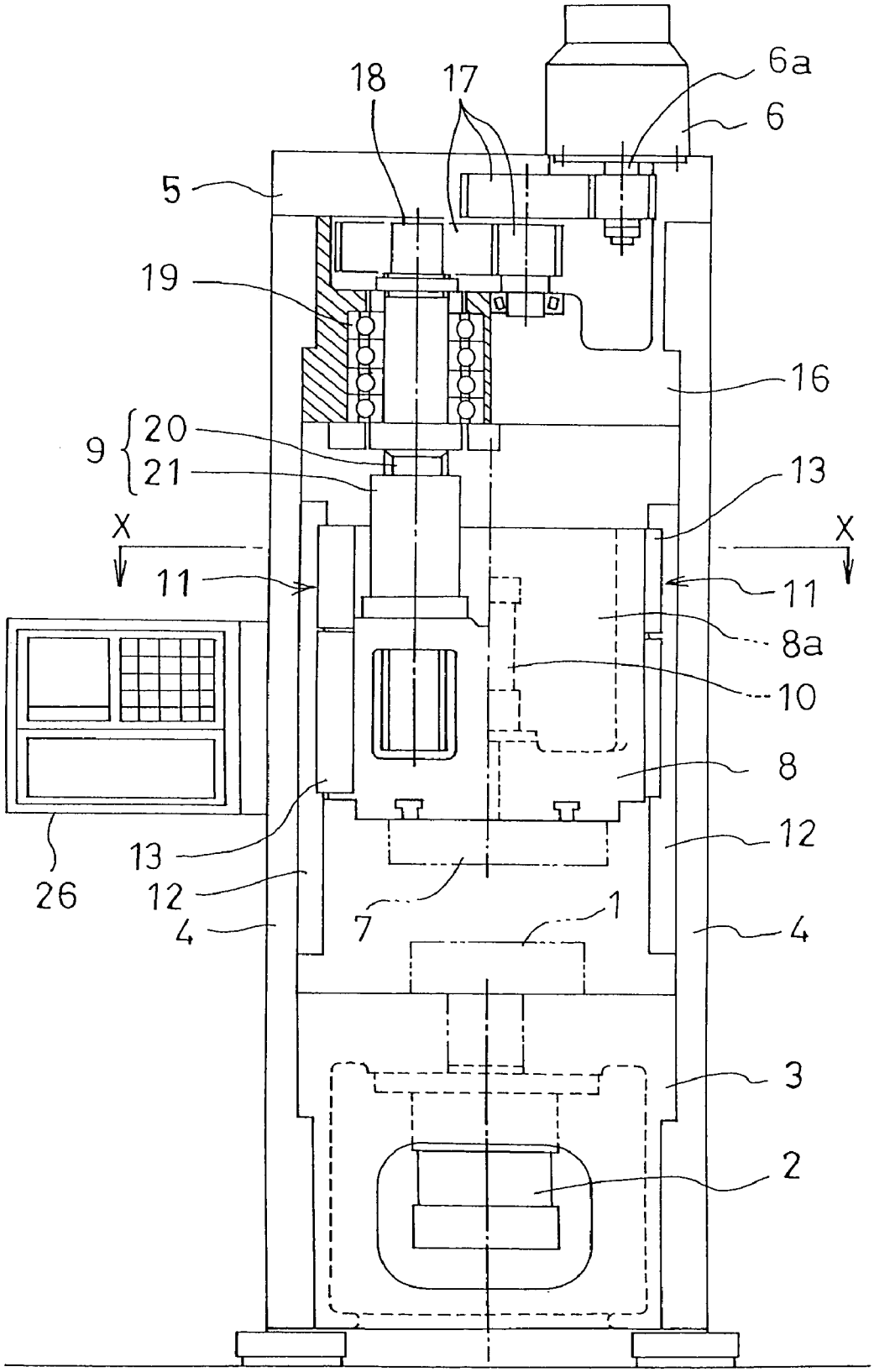
FIG. 1 is a front view of a press to which an embodiment of the invention described in claims 1 through 5 and 9 is applied.
Figure 2:
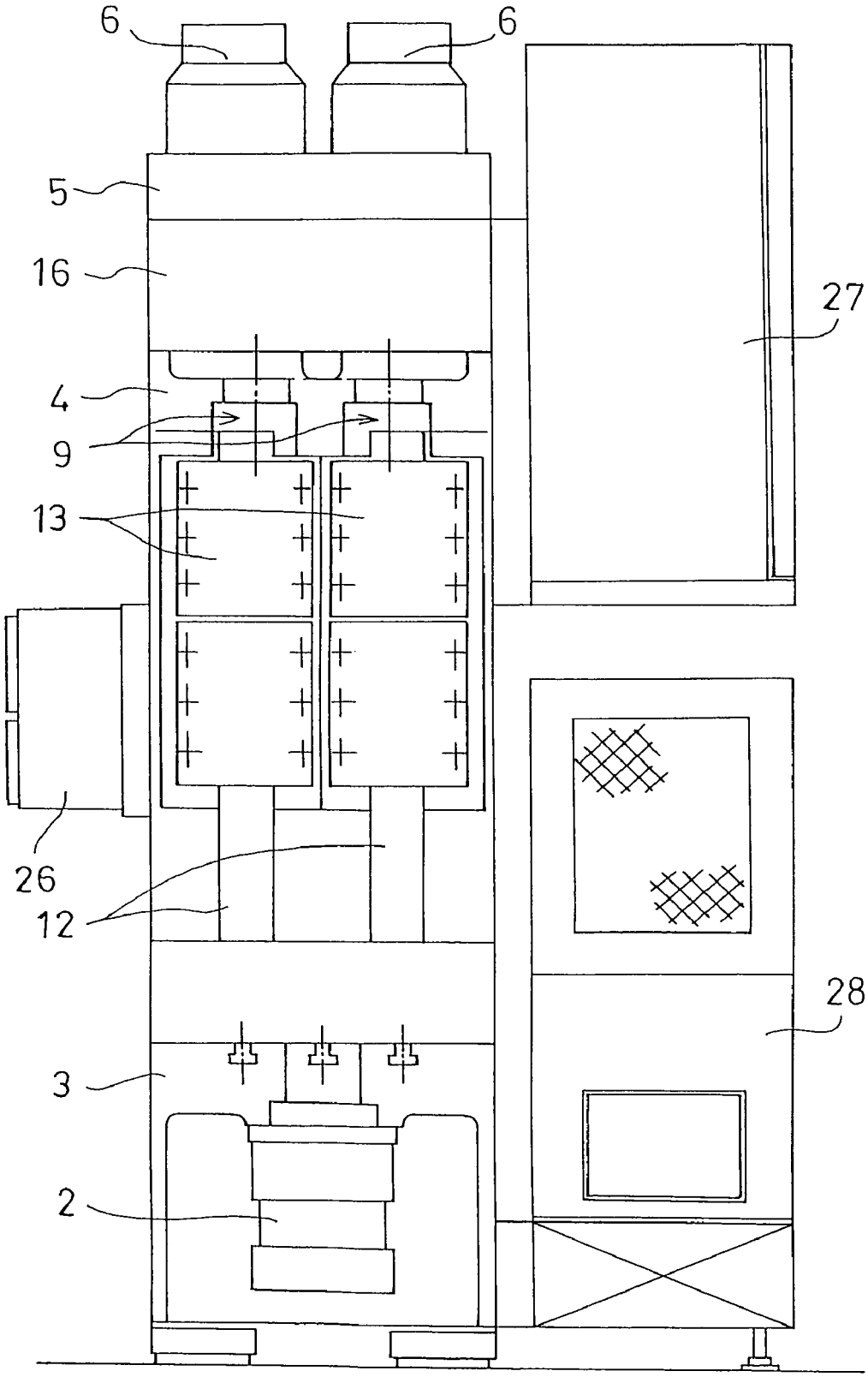
FIG. 2 is a side view of the press shown in FIG. 1.

As shown in FIG. 1, a ground frame 3 is equipped with a hydraulic cylinder 2. A lower die 1 is replaceably mounted on top of the hydraulic cylinder 2 and a knockout pin for removing a formed article or workpiece from the lower die 1 is provided to the bottom of the hydraulic cylinder 2. Plate-like supports 4, 4 are fixed to both of the left and right sides of the ground frame 3 so as to extend upwardly. A gear case 5 is fixedly connected to the plate-like supports 4,4 between the upper ends thereof in a bridge-like form. Servo motors 6, 6 are fixedly supported by the plate-like supports 4, 4 in front of and behind the gear case 5 with the output shafts thereof, 6*a*, 6*a* protruding downwardly.

The left and right plate-like supports 4, 4 are provided with a pressing member 8 by means of a plurality of ball screws 9, 9 or lifting mechanisms. An upper die 7 for pressing and thereby manufacturing a workpiece is replaceably mounted on the lower end of the pressing member 8.

Figure 3:
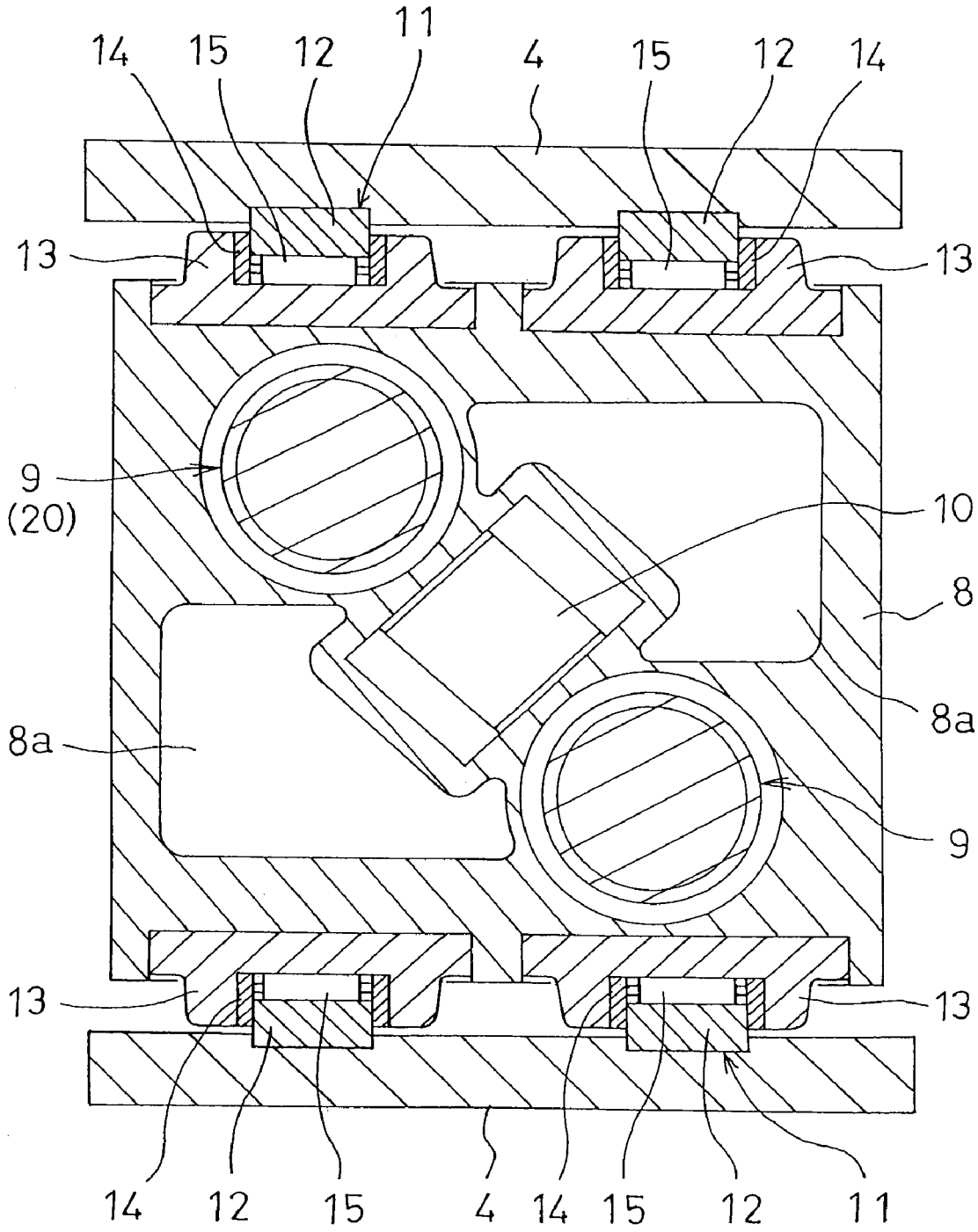
FIG. 3 is a cross-sectional view taken along line X-X in FIG. 1.

The pressing member 8 is made of metal and, as shown in FIG. 3, is cast into a rectangular hollow structure having cavities 8*a*. Receiving spaces are formed within the pressing member 8 in which the ball screws 9, 9 and an upper hydraulic cylinder 10 are to be received and fixed. The upper hydraulic cylinder 10 is provided with a knockout pin for removing a formed article or workpiece from the upper die 7. A total of four roller guides 11, 11, which serve as lift guiding means of the pressing member 8, are provided between the pressing member 8 and the left and right plate-like supports 4, 4 in two lines on each of the left and right sides.

Figure 4:
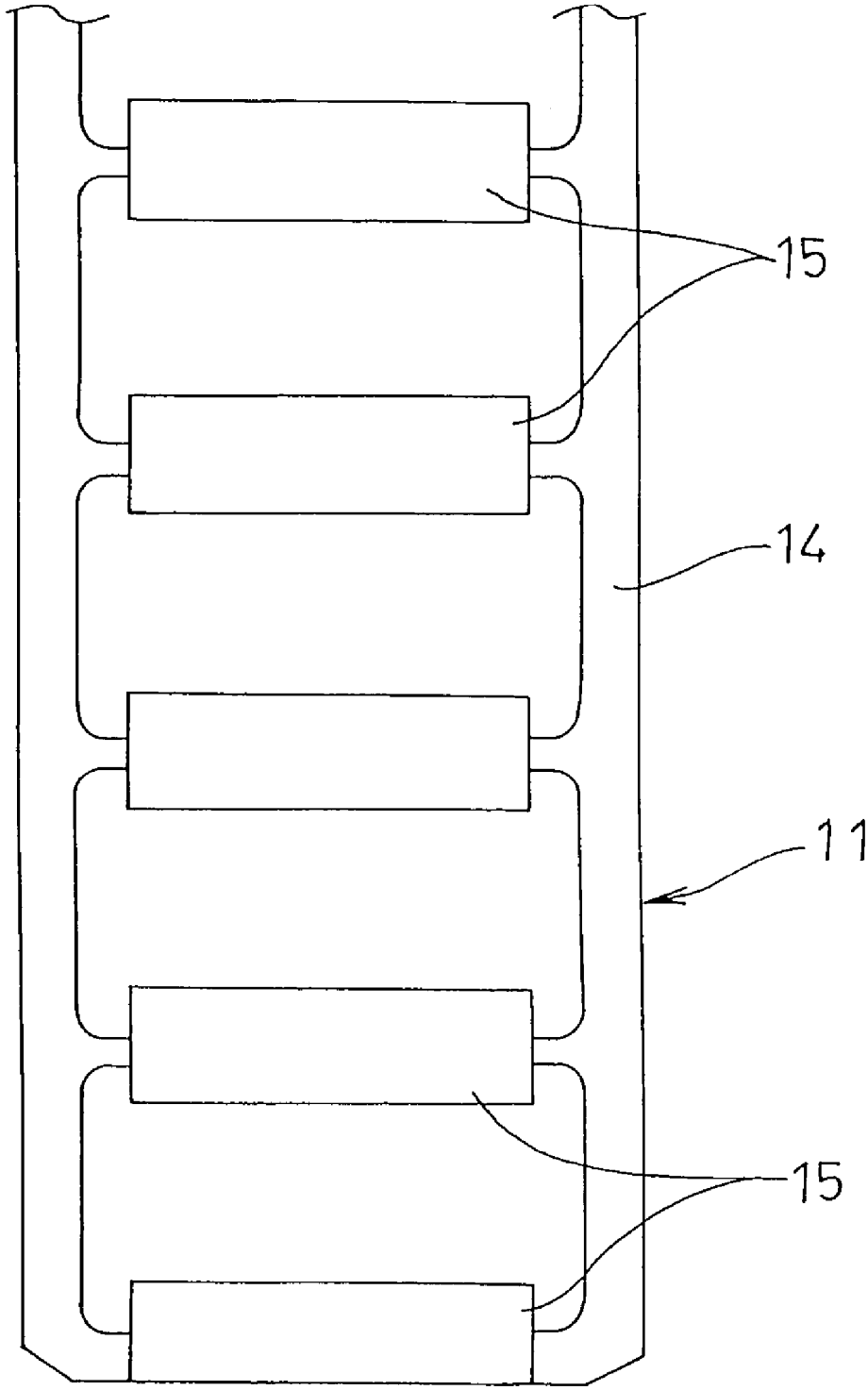
FIG. 4 is an enlarged cross-sectional view of rollers of a roller guide serving as lift guiding means of a pressing member.
Figure 5:
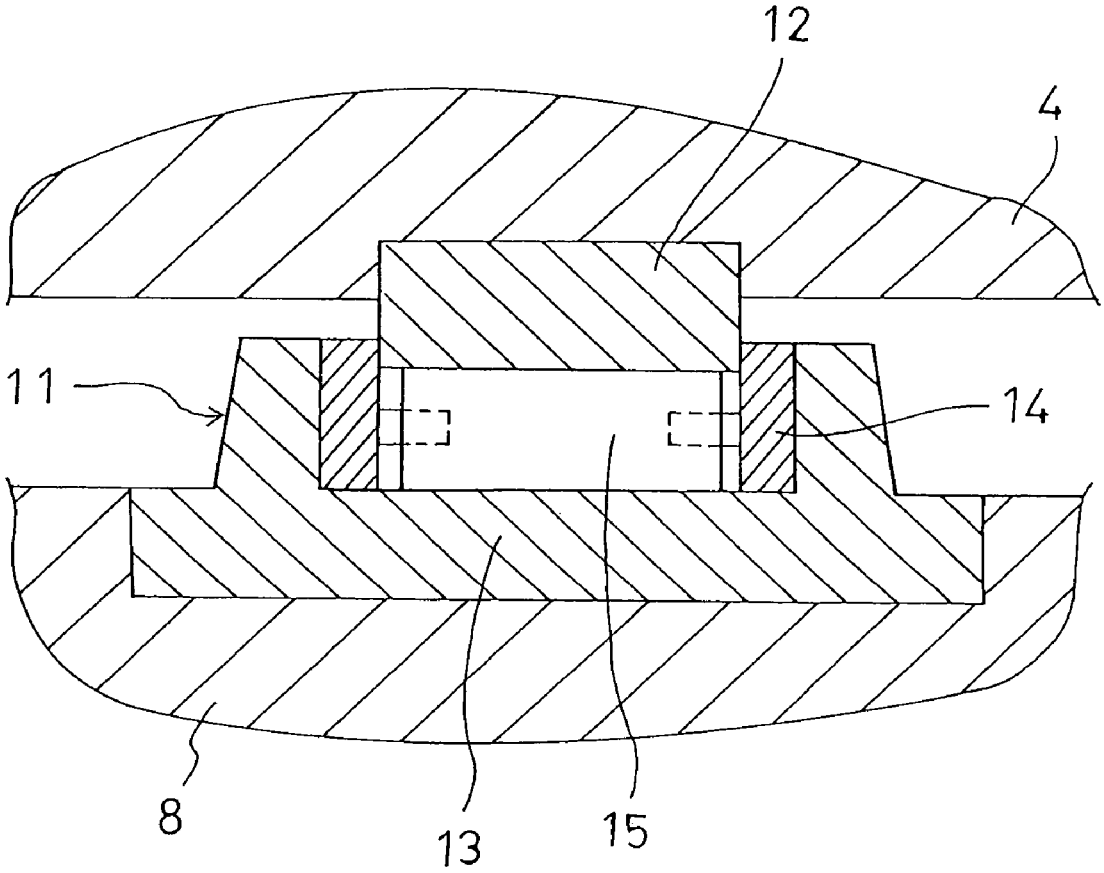
FIG. 5 is an enlarged cross-sectional view of a substantial part of the roller guide.

As illustrated in FIGS. 3 through 5, each of the above mentioned roller guides 11 comprises a rail 12 fixedly mounted on the support 4, a lift block 13 fixedly mounted on the pressing member 8, a low friction and highly-slidable resin or metal retainer 14 fixedly mounted on the lift block 13, and a plurality of rollers 15 rotatably supported by the retainer 14, and is constituted in such a manner that the outer peripheral surface of the roller 15 makes rolling contact with the rail 12 and the lift block 13, so that the up and down movement of the pressing member 8 is smoothly and also accurately guided with low friction.

Figure 6:
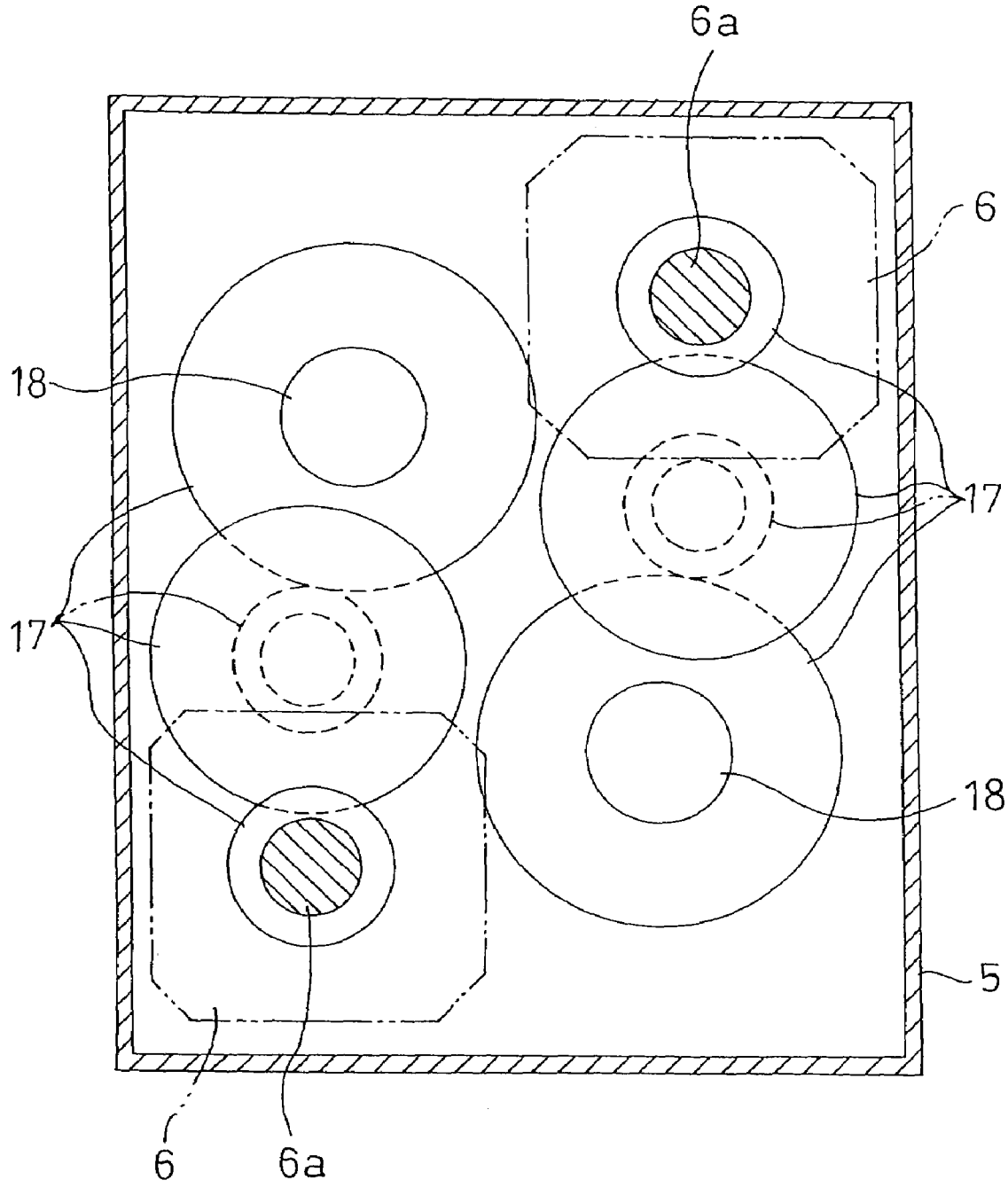
FIG. 6 is a plane view schematically illustrating a driving section.

A stationary block 16 is fixed between the upper ends of the above-mentioned left and right plate-like supports 4, 4. As shown in FIG. 1 and FIG. 6, vertical driving shafts 18, 18 are supported by the stationary block 16 via bearings 19, 19, so that only rotation is possible. The vertical driving shafts 18, 18 are rotationally coupled with the downwardly extending output shafts 6*a*, 6*a* of said servo motors 6, 6 via reduction gear trains 17, 17 disposed in the gear case 5. Said ball screws 9, 9 are interposed between these vertical driving shafts 18, 18 and the above-mentioned pressing member 8.

Figure 7:
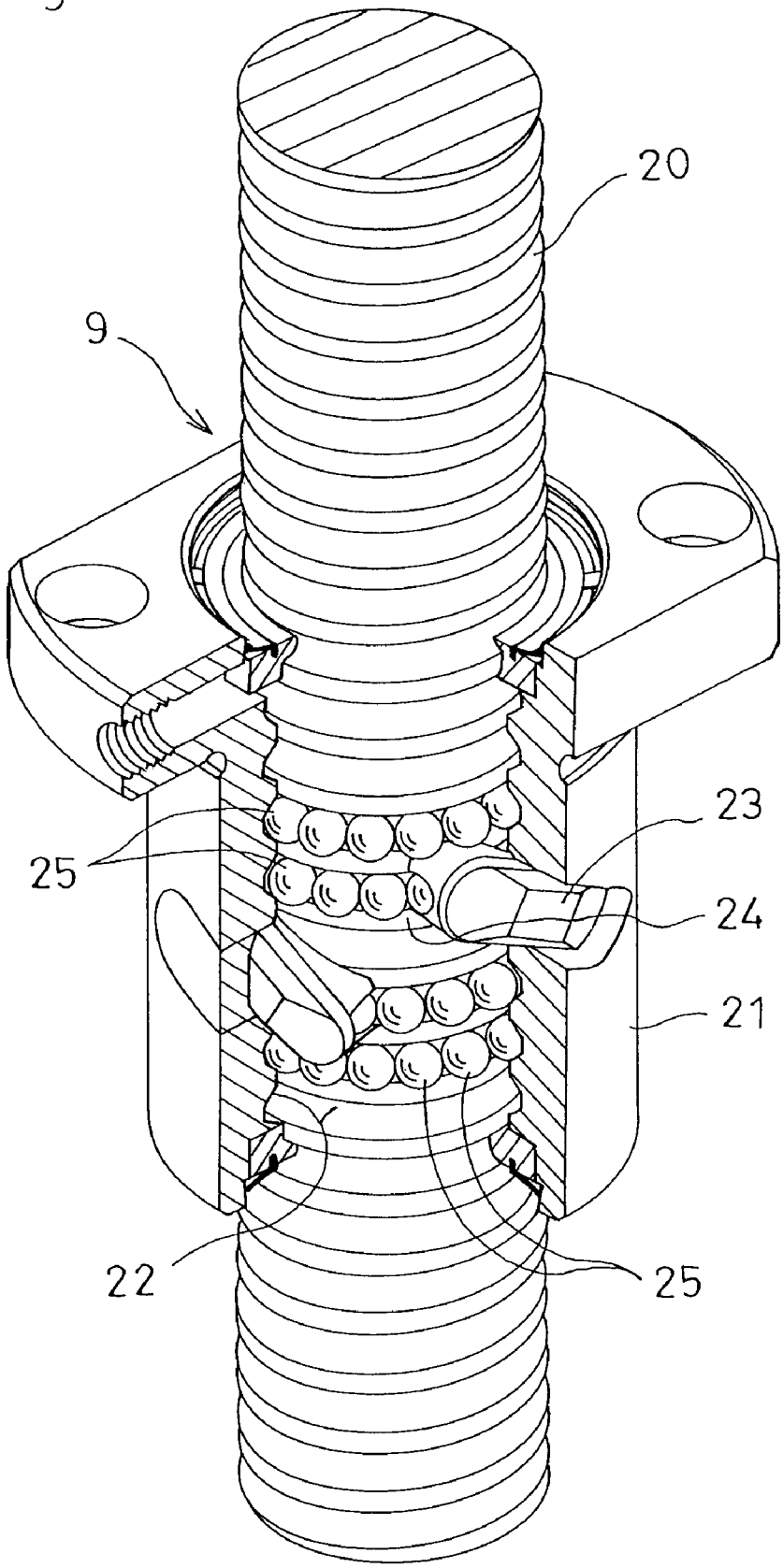
FIG. 7 is a partially cutaway perspective view illustrating a detailed structure of a ball screw.
Figure 8:
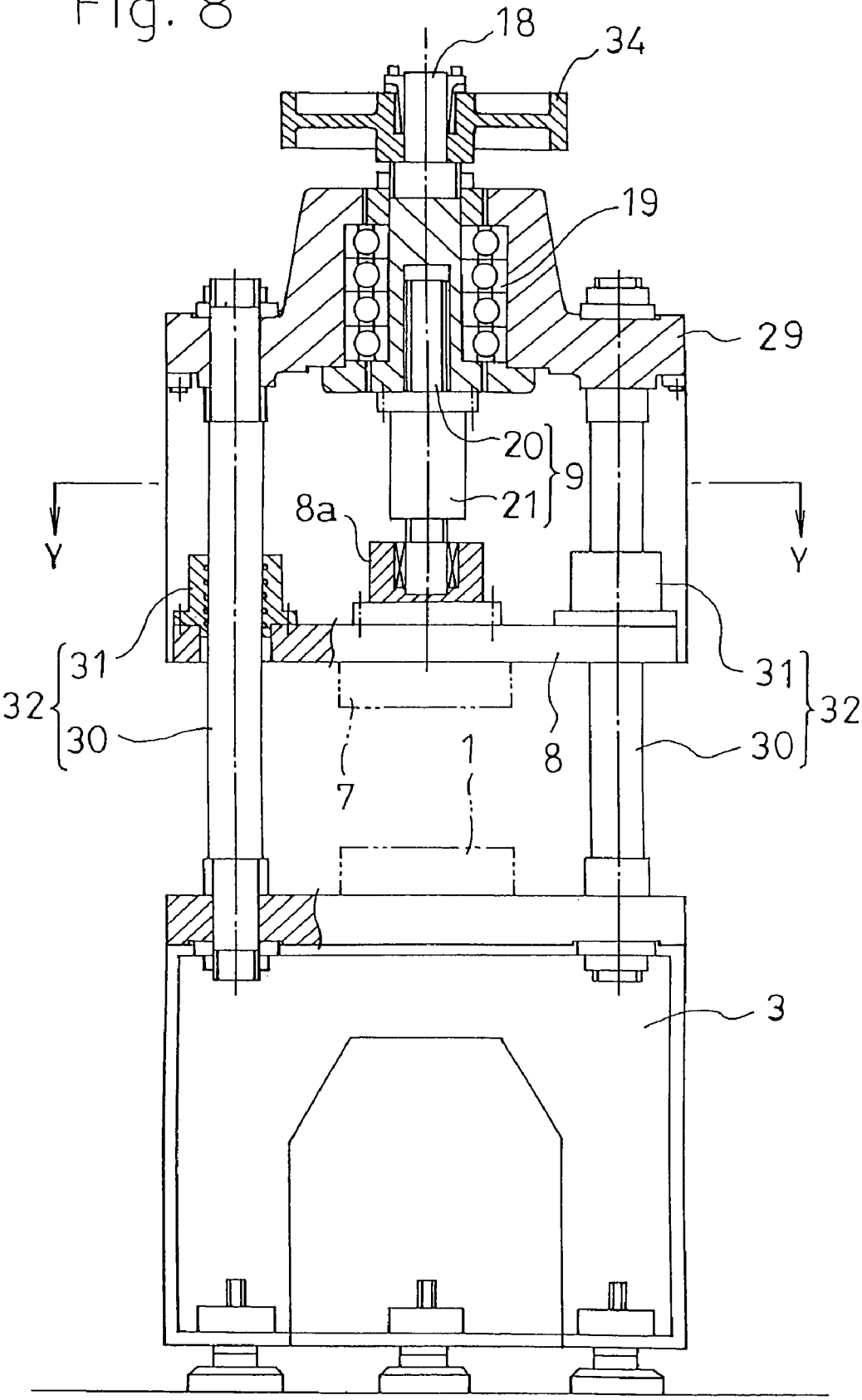
FIG. 8 is a front view of a press to which an embodiment of the invention described in claims 1, 6, and 8 is applied.
Figure 9:
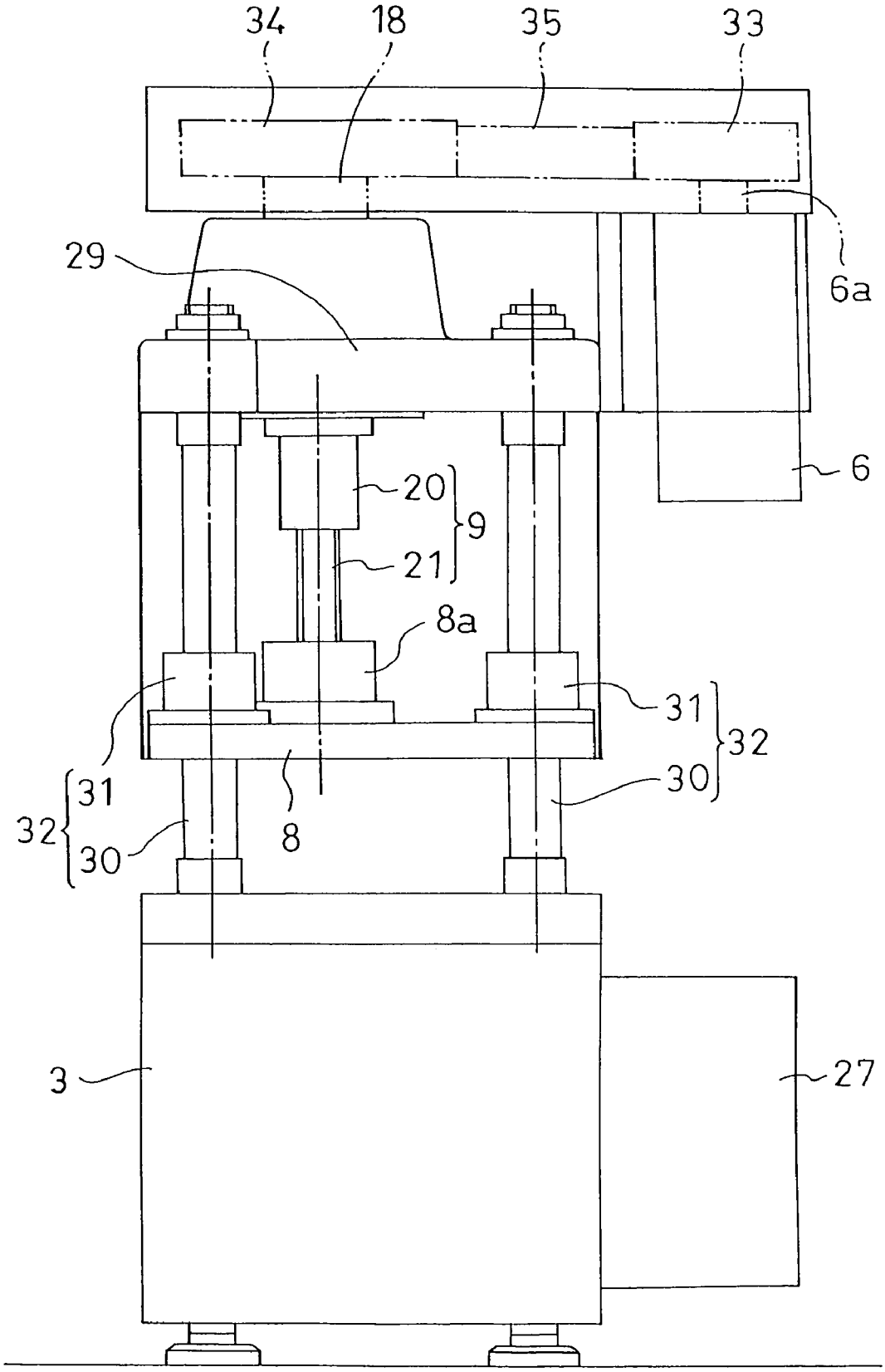
FIG. 9 is a side view of the press shown in FIG. 8.
Figure 10:
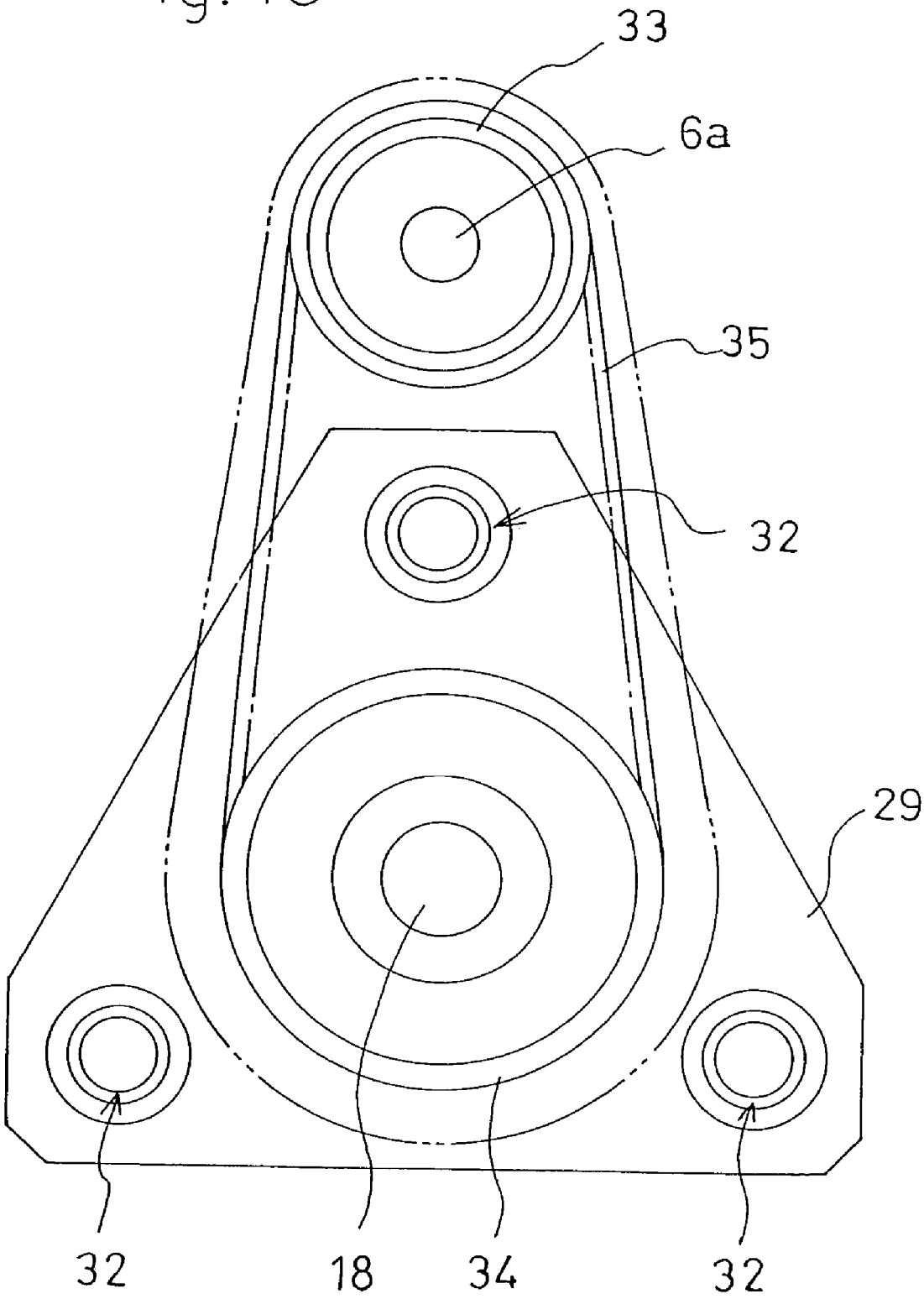
FIG. 10 is a top view of the press shown in FIG. 8.
Figure 11:
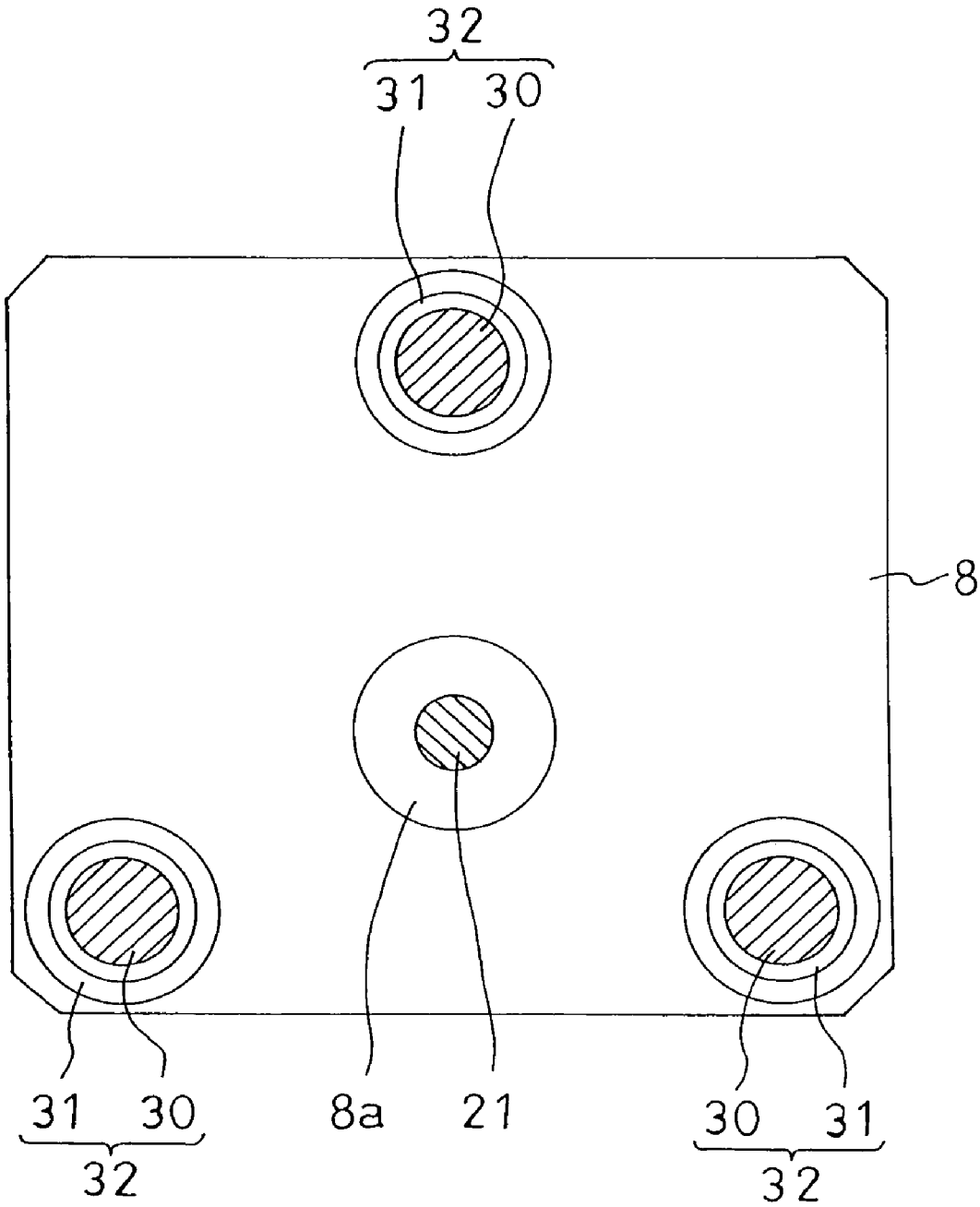
FIG. 11 is a cross-sectional view taken along line Y-Y in FIG. 8.

As shown in FIG. 7, each ball screw 9 is constituted by a ball screw shaft 20 fixedly coupled to the lower end of the vertical driving shaft 18 so as to integrally rotate therewith, a ball screw nut 21 screw threaded with the ball screw shaft 20 and having a lower end fixed to the pressing member 8, helical ball transferring grooves 22 formed on the ball screw shaft 20 and ball screw nut 21, a plurality of balls 25 introduced into these transferring grooves 22 so as to be able to roll, and deflectors 23 embedded in the ball screw nut 21 to cause the balls 25 to circulate by transferring them to the adjacent transferring groove 22 just through a groove 24 formed on the inner peripheral surface of the deflector 23, namely, transferring them for one round of the shaft.

The above mentioned left and right supports 4, 4 are provided, on the side of the front portion thereof, with a controller 26 for programming the numerical data on the pressing condition such as the lifting stroke and lifting actuation speed of the pressing member 8. The left and right supports 4, 4 are also provided, on the back of the upper part thereof, with a numerically controlled apparatus electric board 27 for controlling the rotation of the servo motors 6, 6 in accordance with the data on the pressing condition programmed into said controller 26. Further, a hydraulic unit 28 is fixed on the back of the ground frame 3, which unit controls the fluid pressure applied to said knockout hydraulic cylinders 2, 10.

Now, the operation of the press constituted as above will be briefly described.

First, the numerical data on the pressing conditions, such as the lifting stroke and lifting actuation speed of the pressing member 8, is programmed into the controller 26. Actuation of the servo motors 6, 6 at this state causes the numerically controlled apparatus power magnetics cabinet 27 to control the speed and amount of rotation of the servo motors 6, 6 in accordance with the programmed data. The rotations of the servo motors 6, 6 are transmitted to the vertical driving shafts 18, 18 via the reduction gear trains 17, 17, so that the rotations of the vertical driving shafts 18, 18 are controlled in synchronism with the servo motors 6, 6.

As the vertical driving shafts 18, 18 rotate, the ball screw shafts 20, 20 of the ball screws 9, 9 rotate integrally therewith, causing the ball screw nuts 21, 21 threaded therewith to move up and down with low friction due to the rolling circulation movement of the balls 25 introduced into the transferring groove 22 between the ball screw shaft and nut. As the ball screw nuts 21, 21 move up and down, the pressing member 8 and the upper die 7 move together up and down for the programmed stroke to press the workpiece placed in the lower die 1 and thereby carry out a predetermined press work.

As described above, the driving mechanism of the pressing member 8 is constituted by a combination of the ball screws 9, 9 and the servo motors 6, 6 of which rotation is controllable by the numerically controlled apparatus power magnetics cabinet 27 and no flywheel is employed. This allows reduction in the overall size and weight of the press, and since the loads on the servomotors 6, 6 become not so large as in the case of rotating a flywheel, the motors generate only little noise and vibration, and allow a significant improvement in working environment. Furthermore, since there is no waste of power consumption when the press is on standby or suspended, a great decrease in running cost is achieved through power consumption saving.

Further, the combination of the ball screws 9, 9 that has low friction and excellent mechanical efficiency, and the servo motors 6, 6 that has automatic tracking ability, permits full power output over the entire lifting stroke. Thus, the press is applicable to a wide range of press works in which both large and small pressing forces are required. In addition, the lifting actuation speed and position, lifting stroke, or the like, of the pressing member 8 are controllable flexibly and with ease and high accuracy in accordance with the products to be manufactured, which allows a significant improvement of predetermined press work accuracy.

In particular, the constitution that concentrates the rotational driving forces from two servo motors 6, 6 on one pressing member 8 allows to provide a large press for generating a large pressing force of about 100 to 200 tons, for example. Further, the use of four guide rollers 11 as the lift guiding means for the pressing member 8 allows the overall size of the press to be less than in the case where a supporting guide of a large wall structure extending around the periphery of the pressing member 8 is employed, while preventing skew of the pressing member 8 at the time of applying press load. In addition, the small rolling resistance of the roller ensures stable and smooth up and down movement all the time. Thus, the press allows a further improvement of the press work accuracy.

Next, another embodiment of the press according to the invention described in claims 1, 6 and 8 will be described with reference to the drawings.

This embodiment employs, as shown in FIG. 8 through FIG. 11, a slidably guiding mechanism 32 is used as lift guiding means of the pressing member 8, which mechanism consists of three circular section columnar members 30 provided vertically between the ground frame 3 and an upper supporting block 29 rotatably supporting a single vertical driving shaft 18, and three sliders 31 fixed to the pressing member 8 and fitted onto respective columnar members 30 to be supported thereby. A single ball screw 9 is used as a lifting mechanism of the pressing member 8, which comprises a ball screw nut 21 fixed to the lower end of the vertical driving shaft 18 so as to integrally rotate therewith, a ball screw shaft 20 fixed at the lower end thereof to an upper surface boss **8*a* of the pressing member 8 and screw coupled to the ball screw nut 21, and a plurality of balls 25. Timing pulleys 33, 34 fixed to the output shaft 6*a* of the servo motor 6 and the vertical driving shaft 18, and a timing belt 35 wound around these pulleys 33, 34 are used as rotatably coupling means between said vertical driving shaft 18 and the servo motor 6 fixed to the rear portion of the upper supporting block 29** to be supported thereby. Upper and lower hydraulic cylinders for knockout are not employed. Other constitution of the press is the same as that of the previous embodiment. Thus, like numerals are employed to designate like parts to omit the description thereof.

Since the driving mechanism for the pressing member 8 of the press shown in FIG. 8 through FIG. 11 is also constituted by a combination of the servomotor 6, which has automatic tracking ability and of which rotation is controllable by the numerically controlled apparatus power magnetics cabinet 27, and the ball screw 9 having low friction and excellent mechanical efficiency, significant improvement in working environment due to reduction in the overall size and weight of the press and reduction in noise and vibration of the motor, as well as a large reduction in running cost due to power consumption savings are achieved. In addition, full power output over the entire lifting stroke is possible, which allows the press to be applied to a wide range of press works in which both large and small pressing forces are required. Further, the lifting speed, position, stroke of the pressing member 8, and the like, are easy to control flexibly and with high accuracy in accordance with the products, allowing a remarkable improvement in predetermined press work accuracy.

Further, the use of the slidably guiding mechanism 32, constituted by the columnar member 30 and the slider 31 fitted onto the columnar member 30 to be supported thereby, as the lift guiding means for the pressing member 8 allows the overall size of the press to be less than in the case where a supporting guide of a large wall structure extending around the periphery of the pressing member 8 is employed, while preventing skew of the pressing member 8 at the time of applying press load. In addition, the small rolling resistance of the roller ensures stable and smooth up and down movement of the pressing member 8 all the time. Thus, the press allows an improvement in press work accuracy.

INDUSTRIAL APPLICABILITY

As described above, the present invention is constituted such that a pressing member for pressing a workpiece is driven up and down by a servo motor, of which rotation is controllable, and a ball screw having low friction and excellent mechanical efficiency. Thus, the present invention allows reduction in the overall size and weight, and reduction in noise and vibration of the press, as well as reduction in the running cost of the press due to low power consumption. In addition, the present invention allows preparing data on operation control and machining conditions. Thus, the present invention is a technology that allows a significant improvement in press work accuracy.

The invention claimed is:

1. A press for plastically forming machine parts, comprising:

a support;

a control mechanism;

a pair of servo motors supported by said support;

a lifting mechanism disposed below said pair of servo motors and driven up and down by the rotation of said pair of servo motors;

a hydraulic cylinder having a knockout pin; and a pressing member fixedly coupled to a lower end of said lifting mechanism to press a workpiece, wherein;

the rotation of said pair of servo motors can be controlled by said control mechanism;

said lifting mechanism includes a pair of ball screws, each ball screw comprising a ball screw shaft, a ball screw nut threaded with said ball screw shaft, and balls introduced into transferring grooves so as to be able to roll therein, said transferring grooves being formed on said ball screw shaft and said ball screw nut;

said ball screw shafts of said pair of ball screws are respectively coupled to driving shafts respectively rotatably interconnected with said pair of servo motors, while said ball screw nuts of said pair of ball screws are fixedly coupled to said pressing member;

said balls screw shafts and said ball screw nuts of said pair of ball screws are disposed in a state wherein they are opposed to each other inside said pressing member; and said hydraulic cylinder is disposed between said ball screw shafts and said ball screw nuts of said pair of ball screws.

2. The press according to claim 1, wherein:

said control mechanism includes a numerically controlled apparatus programmable for numerical data on press work conditions.

3. The press according to claim 1, further comprising:

a plurality of roller guides serving as lift guiding means of said pressing member, each roller guide comprising a rail fixed to said support;

a lift block fixed to said pressing member; and a roller making rolling contact at an outer peripheral surface thereof with said rail and said lift block.

4. The press according to claim 1, wherein:

in addition to providing said pair of servo motors and said pair of ball screws for one pressing member, a plurality of roller guides are provided around one pressing member.

5. The press according to claim 1, wherein:

said pair of servo motors and driving shafts corresponding thereto are rotatably interlocked by gear trains.

* * * * *